US012751598B2

(12) United States Patent
Roe

(10) Patent No.: US 12,751,598 B2
(45) Date of Patent: Oct. 6, 2026

(54) ADJUSTABLE CURVED CLEANING DEVICE AND RELATED METHOD

(71) Applicant: CONTEC, INC., Spartanburg, SC (US)

(72) Inventor: Preston Roe, Lyman, SC (US)

(73) Assignee: CONTEC, INC., Spartanburg, SC (US)

( * ) Notice: Subject to any disclaimer, the term of this patent is extended or adjusted under 35 U.S.C. 154(b) by 444 days.

(21) Appl. No.: 18/552,620

(22) PCT Filed: Feb. 17, 2023

(86) PCT No.: PCT/US2023/013280

§ 371 (c)(1),
(2) Date: Sep. 26, 2023

(87) PCT Pub. No.: WO2023/158779

PCT Pub. Date: Aug. 24, 2023

(65) Prior Publication Data

US 2024/0164614 A1 May 23, 2024

Related U.S. Application Data

(60) Provisional application No. 63/312,157, filed on Feb. 21, 2022.

(51) Int. Cl.
*A47L 13/258* (2006.01)

(52) U.S. Cl.
CPC ..... *A47L 13/258* (2013.01)

(58) Field of Classification Search
CPC ..... A47L 13/258; A47L 13/25; A47L 13/254; A47L 13/256; A47L 25/12; A47L 13/20; A47L 13/38; A46B 7/02
USPC ..... 15/149, 228, 172
See application file for complete search history.

(56) References Cited

U.S. PATENT DOCUMENTS

| | | | | |
|---|---|---|---|---|
| 1,085,607 | A | 2/1914 | Haynes | |
| 4,845,800 | A * | 7/1989 | Pederson | A47L 13/258 15/228 |
| 8,528,146 | B1 * | 9/2013 | Abrahamson | A46B 5/0045 15/160 |
| 10,076,221 | B2 * | 9/2018 | Cook | B25G 1/04 |
| 10,959,595 | B2 * | 3/2021 | Diedrichs | A46B 5/026 |
| 2007/0010356 | A1 | 1/2007 | Moller | |
| 2011/0167583 | A1 | 7/2011 | Weaver | |
| 2014/0237749 | A1 * | 8/2014 | Yang | A47L 13/24 15/228 |
| 2015/0082570 | A1 | 3/2015 | Davidshofer et al. | |
| 2021/0310147 | A1 | 10/2021 | Lapelosa | |

FOREIGN PATENT DOCUMENTS

| | | | | |
|---|---|---|---|---|
| CN | 111281294 A * | 6/2020 | | A47L 13/258 |
| DE | 4202312 A1 * | 8/1993 | | A46B 9/10 |
| KR | 101147814 B1 * | 5/2012 | | A47L 13/24 |

* cited by examiner

*Primary Examiner* — Laura C Guidotti
(74) *Attorney, Agent, or Firm* — J.M. Robertson, LLC

(57) ABSTRACT

An adjustable curvature cleaning structure adapted to clean both flat and curved surfaces. The cleaning structure includes a frame having a base operatively engaging an elongated handle structure and at least one arm projecting away from the base. The arm includes multiple link elements with hinges disposed between the link elements such that the arms are bendable in curved relation to adjust elevation relative to the base. At least one adjustable length cable extends along the arm and is operatively connected to a length adjustment mechanism.

9 Claims, 6 Drawing Sheets

ADJUSTABLE CURVED CLEANING DEVICE AND RELATED METHOD

CROSS REFERENCE TO RELATED APPLICATION(S)

This nonprovisional application claims the benefit of, and priority from, copending provisional application 63/312,157 having a filing date of Feb. 21, 2022, the contents of which are hereby incorporated by reference in their entirety as if fully set forth herein.

TECHNICAL FIELD

This application is directed to cleaning products, and more particularly to a mop or other cleaning tool adapted for use in cleaning non-planar surfaces. The cleaning tool incorporates a deformable frame adapted for attachment to an elongated handle.

BACKGROUND

Flat mops and cleaning wands are used for many household, commercial and industrial surface cleaning requirements. Such flat cleaning devices offer the benefit of cleaning a relatively large surface area in a short period of time due to the large cleaning surface provided by the substantially planar cleaning surface. However, a flat cleaning device may be impractical for cleaning curved surfaces. By way of example only, such curved surfaces may be found in both household and industrial environments and may include interior and exterior surfaces of tubs, piping, holding tanks and the like. Specifically, if the surface to be cleaned has a concave profile (such as the interior of a holding tank), it may be impractical to access the interior depressed portion of the curved surface using a flat cleaning structure. Likewise, if the surface to be cleaned has a convex profile (such as an overhead pipe), it may be difficult to clean more than a small portion of the projecting curved surface. Thus, a flat cleaning device with large surface area may be less effective.

While the difficulty in using substantially flat cleaning devices to clean curved surfaces may be addressed to some degree by using smaller devices and/or by making multiple cleaning passes using only a portion of the cleaning surface, these measures may introduce substantial inefficiency into the cleaning process. Devices with built-in curvature may be used to address the problem in some environments of use. However, such devices may nonetheless have limited utility in cleaning a wide range of surfaces with different curvatures.

Considering the various noted problems associated with current flat mops and other cleaning devices, an alternative construction which eliminates such problems would represent a useful advancement over the current art.

SUMMARY

The present disclosure offers advantages and alternatives over the prior art by providing a cleaning tool incorporating a selectively adjustable frame adapted for attachment to an elongated handle. The frame may be used flat or may be adjusted by a user to adopt a range of curvatures. Thus, the curvature of the frame can be varied on demand based on the surface to be cleaned. That is, the frame can be adjusted by a user across a full range of curvatures between convex and concave curvatures as desired. The adjustment may be carried out to achieve substantially any curvature as may be desired.

In a mop, the frame (also referred to as a mop head) may have a shape corresponding generally to known mop heads. In a wand, the frame may be an elongated extension for attachment to a handle and may have a construction corresponding generally to one half of a mop head as will be described hereinafter. In either a mop or wand construction, the frame preferably incorporates a multiplicity of operatively connected linking members to provide bending flexibility. The frame may be adapted to support one or more disposable pads, sleeves, or other cleaning elements.

In one exemplary construction, adjustable length cables extend longitudinally in the major length direction of the frame between an adjustment spool and distal ends of the frame. In response to adjustment by a user, cable segments may be simultaneously shortened and lengthened to introduce either convex or concave curvature along the major length dimension. Specifically, as one cable segment is lengthened, an opposing corresponding segment within the same arm of the frame may be simultaneously shortened. The frame is thereby curved upwardly or downwardly using a single adjustment action. Moreover, the adjustment is fully reversable.

In accordance with one exemplary aspect, the frame may be made up of substantially rigid discrete linking structures operatively joined by attached flexible straps and/or intermediate flexible segments. Such flexible attachment structures define living hinges having the ability to bend to accommodate the applied curvature and to then recover without impermissible loss of structural integrity. A manual or electronic control operatively connected to a collection spool may be used to adjust the curvature of the frame by concurrently lengthening and shortening adjustment cables. This control permits the frame to take on a flat, a convex, or a concave configuration as may be desired. Moreover, these configurations can be changed by fine degrees such that the degree of curvature may be infinitely adjustable over a range of curvatures. Thus, the same frame may be used to clean concave, convex and flat surfaces as may be desired.

In accordance with one exemplary feature, an adjustable curvature cleaning structure adapted to clean both flat and curved surfaces is provided. The exemplary cleaning structure includes a frame having a base operatively engaging an elongated handle structure and a pair of arms projecting away from the base. The arms include a plurality of link elements of polymer or metal with hinges disposed between the link elements such that the arms are bendable in curved relation to adjust elevation relative to the base. At least one adjustable length cable extends along the arms and a proximal end of the cables is operatively connected to a length adjustment mechanism disposed at the base.

Other aspects, features and advantages of the disclosure will become apparent to those of skill in the art upon review of the following detailed description, claims and drawings.

BRIEF DESCRIPTION OF THE DRAWINGS

The accompanying drawings, which are incorporated in, and which constitute a part of this specification, illustrate exemplary constructions and procedures in accordance with the present disclosure and, together with the general description of the disclosure given above and the detailed description set forth below, explain the principles of the disclosure wherein.

Figure 1:
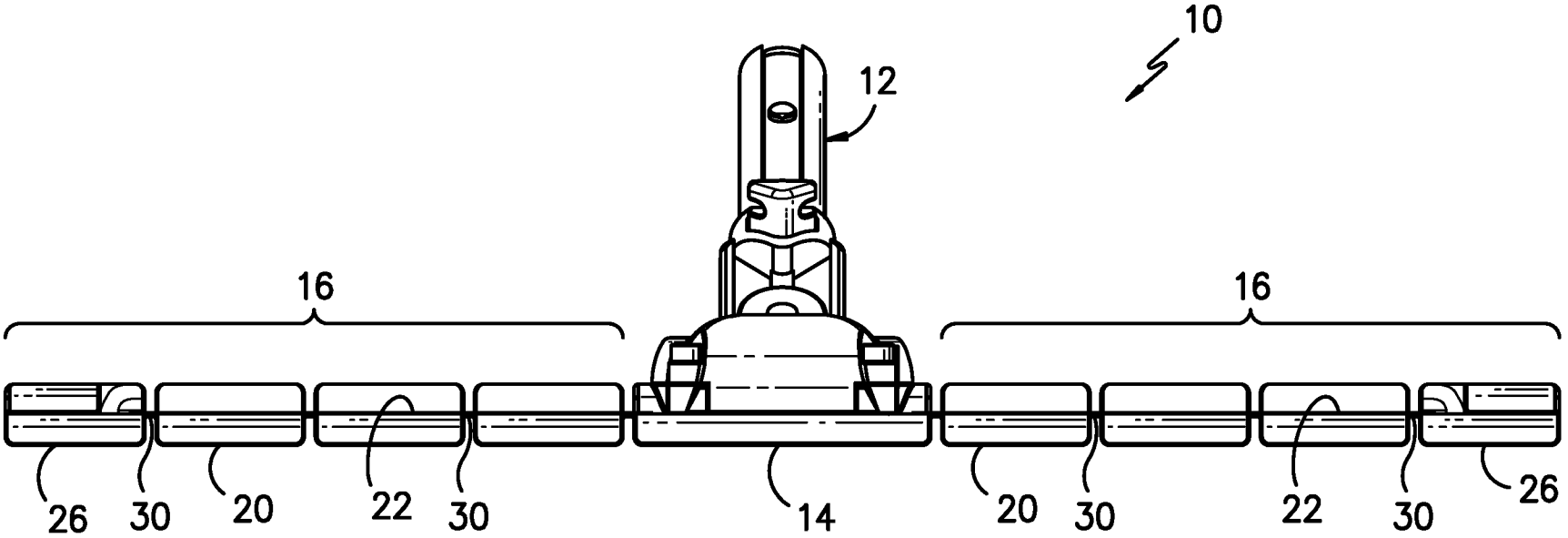
FIG. 1 is a schematic front view of an exemplary mop frame consistent with the present disclosure in attached relation to an elongate handle.

Before the exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and being practiced or being carried out in various ways. Also, it is to be understood that the phraseology and terminology used herein are for purposes of description only and should not be regarded as limiting. The use herein of terms such as "including" and "comprising", and variations thereof is meant to encompass the items listed thereafter and equivalents thereof as well as additional items and equivalents thereof.

DETAILED DESCRIPTION OF EXEMPLARY EMBODIMENTS

Figure 2:
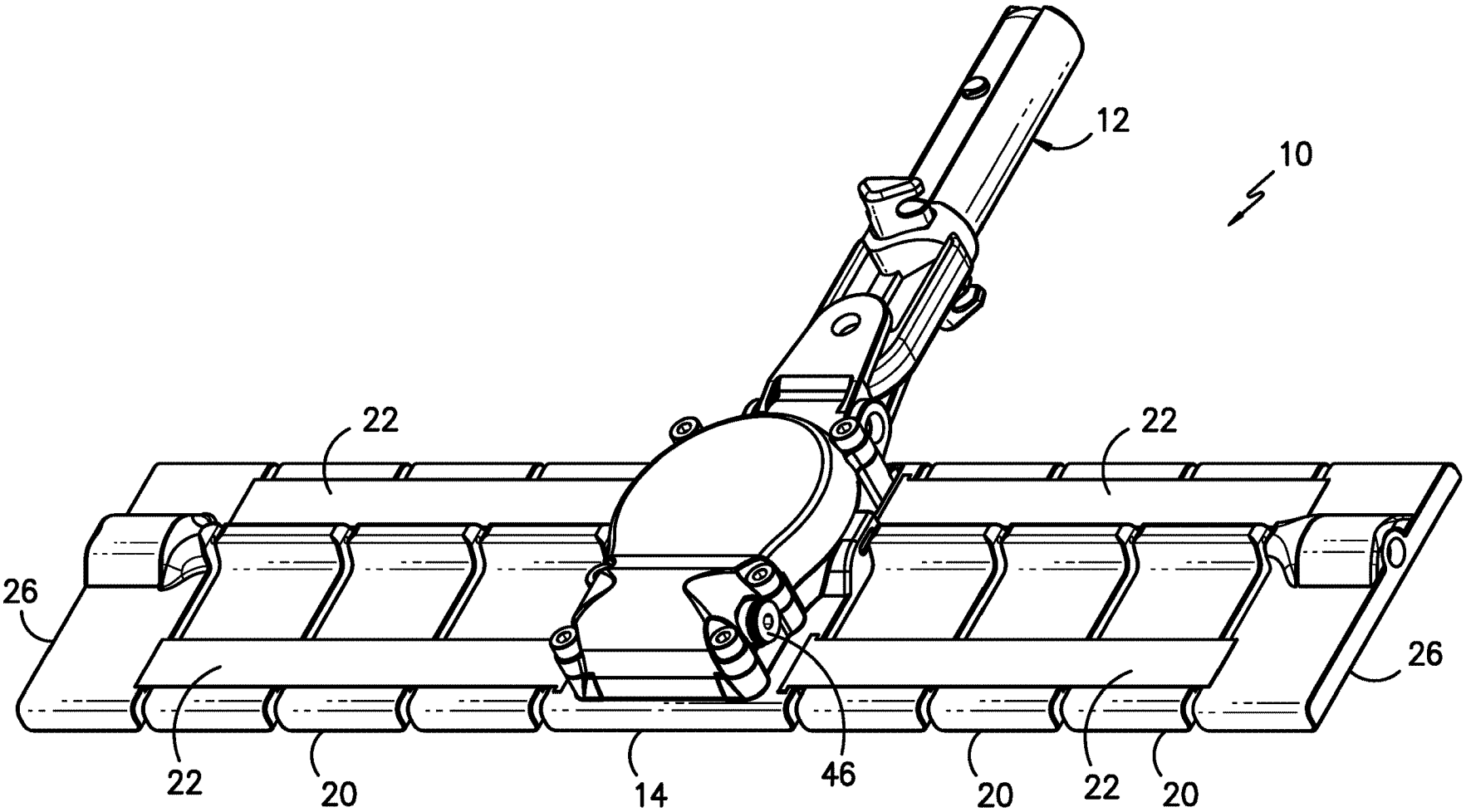
FIG. 2 is a partial cut-away elevation perspective view illustrating the exemplary mop frame of FIG. 1 with linking straps exposed.

Exemplary constructions and practices will now be described through reference to the drawings wherein like elements are designated by like reference numerals in the various views. FIGS. 1 and 2 illustrate an exemplary mop frame 10 (also referred to as a mop head) consistent with the present disclosure. In this regard, it will be understood that while the present disclosure provides a description in relation to a mop frame, the concepts described are equally applicable to a wand structure which may be constructed as one arm of the illustrated and described mop frame 10. As shown, mop frame 10 is adapted to be connected in pivoting relation to an elongated handle 12 through a suitable connection element at a central base 14 in a manner as will be known to those of skill in the art.

In the illustrated exemplary construction, a pair of laterally extending arms 16 extend outwardly from central base 14 to define support surfaces for disposable cleaning elements such as socks, pads, sponges, or the like (not shown). As illustrated, in the exemplary construction, the laterally extending arms 16 comprise a plurality of substantially rigid, discrete link elements 20 formed from a suitable plastic such as nylon, polyester, polypropylene, or the like or metal such as aluminum, stainless steel or the like or combinations of any such materials. As shown, link elements 20 may have a generally rectangular configuration with a major length dimension of the rectangles oriented generally in the mopping direction, although other geometries may likewise be used if desired.

In the illustrated exemplary construction, a pair of flexible ribbons 22 extends longitudinally away from base 14 to distal end links 26 within each arm. In accordance with one exemplary practice, ribbons 22 may be formed from a suitable plastic such as nylon, polyester, polypropylene, or the like and may preferably be the same material as link elements 20. Ribbons 22 may be secured to link elements 20 by any suitable technique including point fusion bonding, adhesive bonding, mechanical fasteners or the like as may be desired. In the connected state, ribbons 22 form an operative connection between link elements 20. This operative connection provides structural integrity within arms 16. Ribbons 22 also define living hinges 30 at the spaces between link elements 20. In this regard, the flexible nature of ribbons 20 permits multiple cycles of bending in either convex or concave orientations without loss of structural integrity.

In an alternative construction, it is contemplated that elongate ribbons 22 may be substituted with discrete flexible hinges such as connecting tabs of a suitable plastic material such as nylon, polyester, polypropylene, or the like between link elements. Individual connecting tabs are preferably formed from the same material as the link elements. In such a construction, the individual connecting tabs operatively connect the link elements while also defining living hinges for bending. By way of example only, such connecting tabs may be formed integrally with the linking elements during a molding process. However, such connecting tabs may also be attached by any combination of heat or adhesive bonding, mechanical fasteners or the like independently of any molding process.

Figure 3:
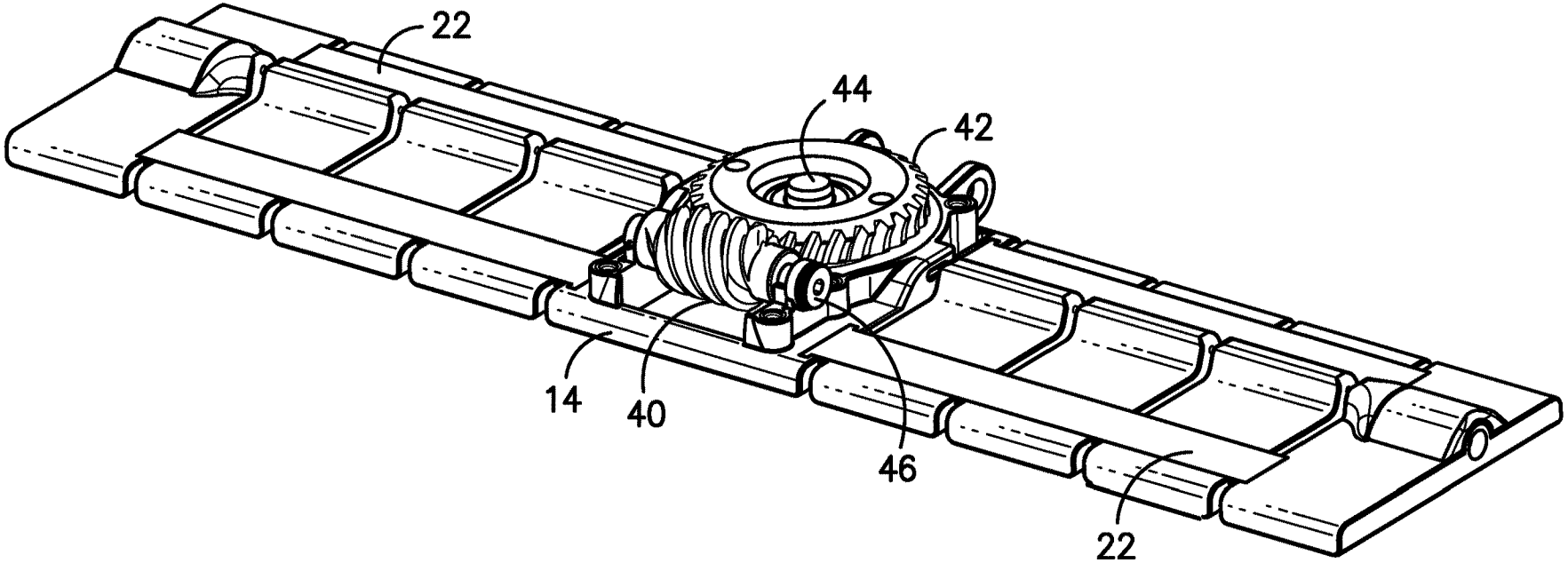
FIG. 3 is a partial cut-away view illustrating the exemplary mop frame of FIG. 1 with the spool cover removed and linking straps exposed.
Figure 4:
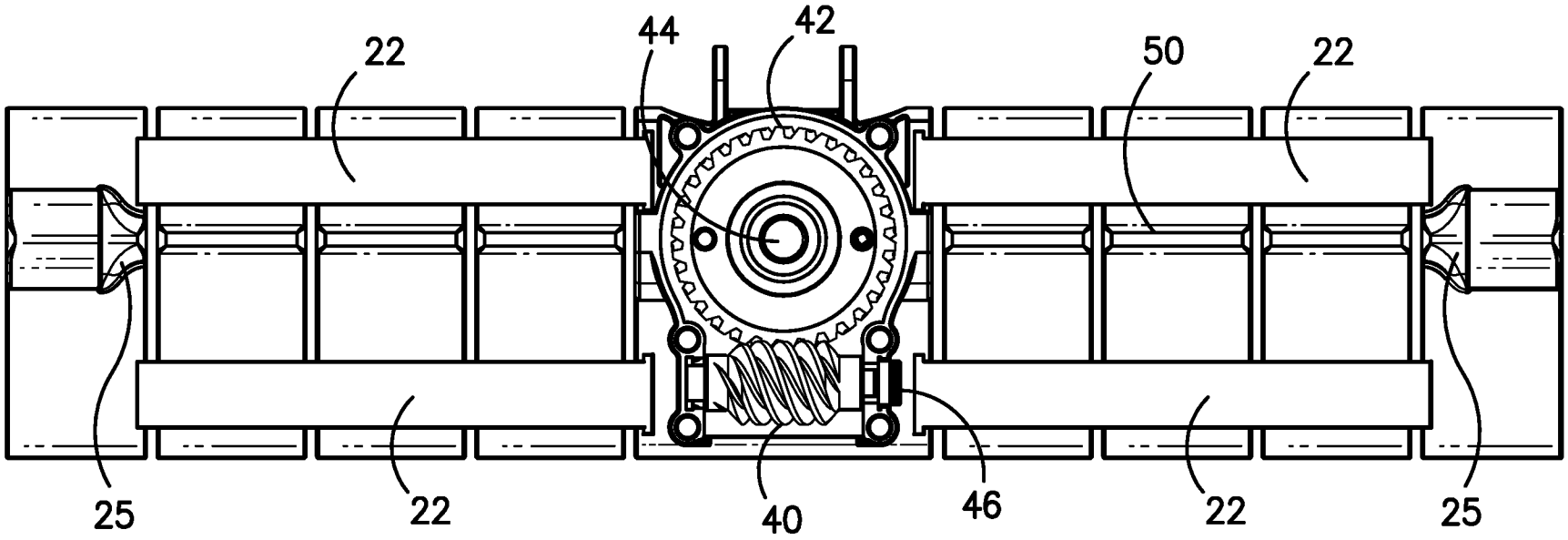
FIG. 4 is an elevation view corresponding to FIG. 3 illustrating an exemplary worm gear and spool mechanism operatively connected to adjustment cables extending in the length dimension on either side of the spool mechanism.

Referring now to FIGS. 3 and 4, an exemplary adjustment mechanism to impart controlled bending will now be described. As illustrated, in one exemplary construction a worm gear 40 may be positioned to drive a ring gear 42 operatively connected to a central spool 44. Each of the worm gear 40, ring gear 42 and spool 44 may be formed from a suitable plastic such as nylon, polyester, polypropylene, or the like or metal such as aluminum, stainless steel or the like or combinations of any such materials. In operation, worm gear 40 may be rotated in either direction using a manually insertable driver (not shown) such as a hex key or the like within an aligned acceptance opening 46. Of course, an electric drive or the like may also be used if desired. Regardless of the drive technique used, rotation of worm gear 40 imparts rotation to ring gear 42 and to the operatively connected spool 44. In this regard, rotation of worm gear 40 in one direction will impart a generally clockwise rotation to ring gear 42 and spool 44 while rotation of worm gear 40 in the opposite direction will impart a generally counterclockwise rotation to ring gear 42 and spool 44. Worm gear 40 is preferably set with a sufficient rotational friction such that positioning remains fixed in the absence of intentional adjustment. That is, worm gear 42 preferably remains in a fixed position in the absence of an applied adjustment driving force.

Figure 5:
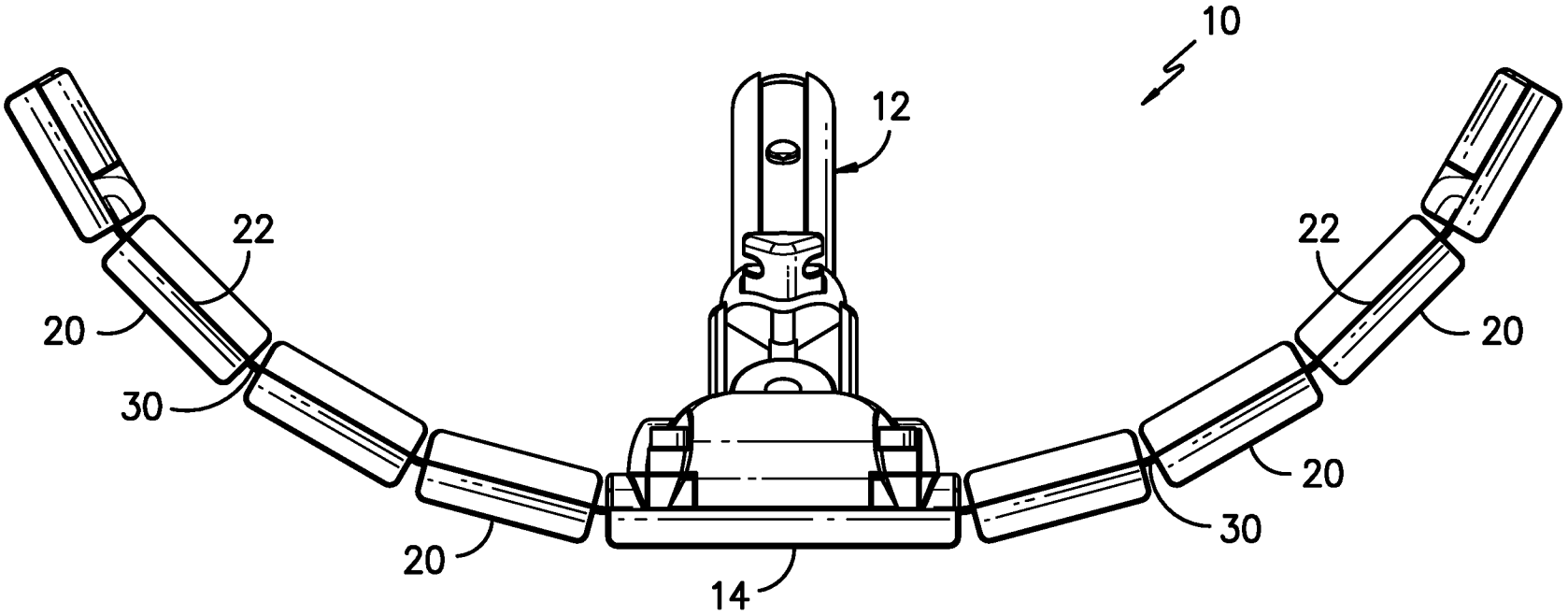
FIG. 5 is a schematic front view corresponding to FIG. 1 with the frame adjusted to a convex profile.
Figure 6:
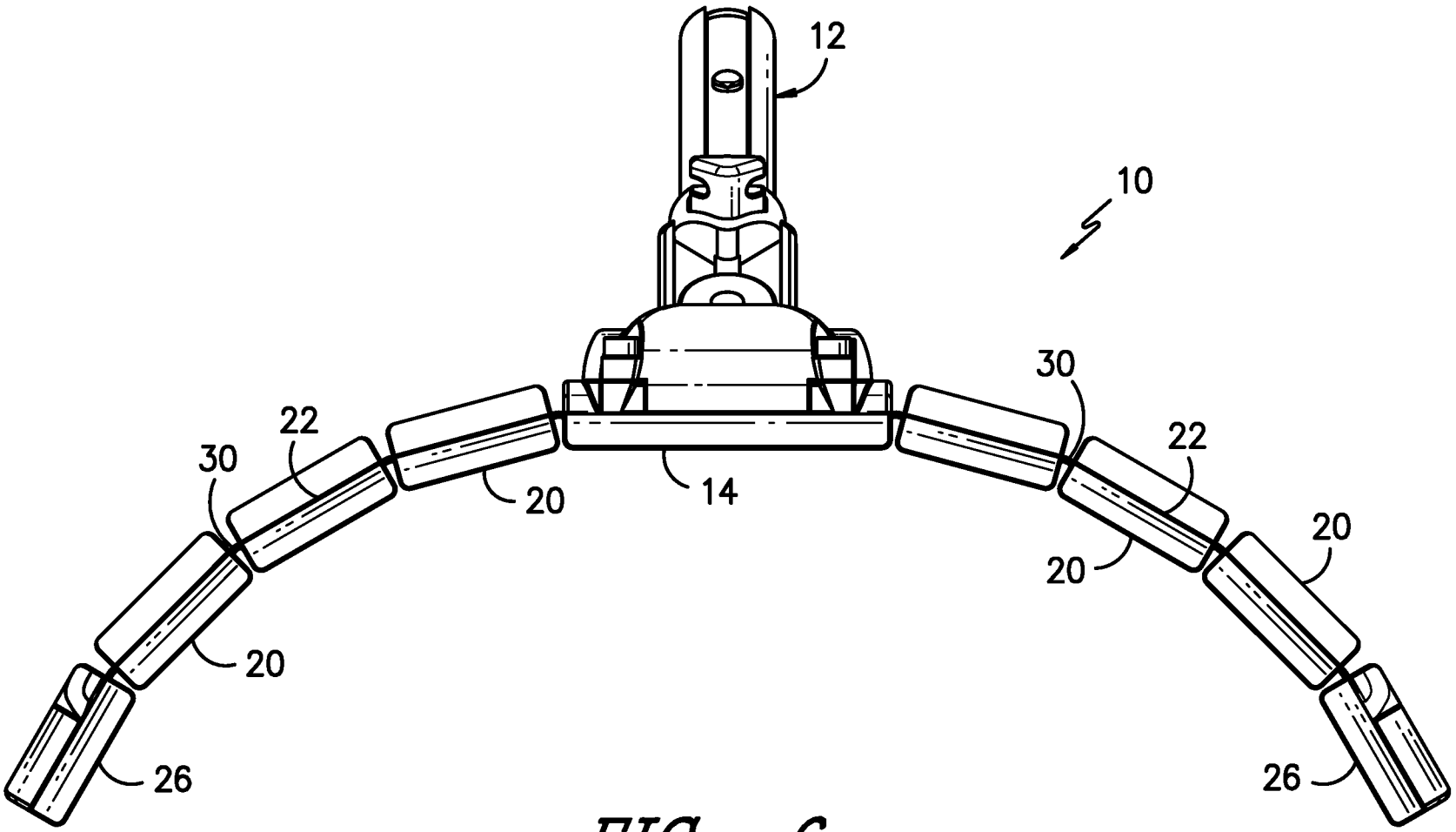
FIG. 6 is a schematic front view corresponding to FIG. 1 with the frame adjusted to a concave profile.

In the illustrated exemplary construction, cables 50 may extend away from spool 44 in looped relation around a post or other guide structure 25 at distal positions on arms 16 with proximal ends of the cables 50 wound in opposite directions at the top and bottom of spool 44. In this arrangement, rotation of ring hear 42 and spool 44 in either direction will cause a simultaneous release of cable 50 at the end wound in one direction and take-up of cable 50 at the end wound in the other direction. This simultaneous take-up and release at opposite ends of the looped cable imparts bending to the arms 16. By way of example, a take-up of cable wound at the top of spool 44 is accompanied by a release of cable wound in the opposite direction at the bottom of spool 44 and results in upward curvature as shown in FIG. 5. Likewise, a take-up of cable wound at the bottom of spool 44 is accompanied by a release of cable wound in the opposite direction at the top of spool 44 and results in downward curvature as shown in FIG. 6. Cables 50 may be formed from any suitable material including metals such as stainless steel and the like, and polymers such as nylon, polyester, polypropylene, or the like in multifilament or monofilament constructions similar to fishing line.

As best seen in FIG. 3, cables 50 may be housed within ridged covers on linking elements 20 in the major length dimension of the frame (i.e. perpendicular to the mopping direction) in substantial alignment with spool 44. Such positioning aids in preventing the laterally extending arms from twisting when the cables are shortened or lengthened to introduce curvature. As shown, the path of cables 50 need not bisect arms 16 and may be positioned between a longitudinal centerline and a rear ribbon 22.

Of course, the present disclosure is subject to a wide array of alternatives. By way of example only, the frame may be in the form of a wand extension that can be operatively connected to a pole or handle. In this regard, the wand extension may have a structure substantially similar to one side of the illustrated mop frame. Thus, the wand structure may be set to a reversable curved orientation and then be used with a cleaning sock, cloth, pad, or other material to clean curved surfaces such as pipes, tanks, and the like.

In accordance with other alternatives, it is likewise contemplated that separate controls may be used to adjust the cable lengths on each side of a mop head such that the sides may be curved independently from one another. It is also contemplated that an electric motor or other device may be used in place of manual adjustment to carry out the cable length adjustment.

It is to be understood that preferred embodiments of this disclosure are described herein, including the best mode known to the inventors for carrying out the disclosure. However, variations of those preferred embodiments may become apparent to those of ordinary skill in the art upon reading the foregoing description. It is expected that skilled artisans may employ such variations as appropriate, and that the disclosure may be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Various features of the disclosure are set forth in the following claims.

What is claimed is:

1. An adjustable curvature cleaning structure adapted to clean both flat and curved surfaces, the cleaning structure comprising:

a frame comprising a base operatively engaging an elongated handle structure and at least one arm projecting away from the base, said at least one arm comprising a plurality of link elements of polymer or metal with hinges disposed between said link elements such that said at least one arm is bendable upwardly and downwardly in curved relation relative to said base;

at least one adjustable length cable extending along said at least one arm, wherein at least a portion of said hinges are polymer living hinges and wherein said living hinges comprise segments of polymer ribbons extending in the major length dimension of said at least one arm.

2. The cleaning structure as recited in claim 1, comprising a pair of arms projecting laterally away from opposing sides of the base.

3. The cleaning structure as recited in claim 1, wherein said plurality of link elements are formed from a polymer selected from the group consisting of nylon, polyester, polypropylene and combinations thereof.

4. The cleaning structure as recited in claim 1, wherein said at least one adjustable length cable is formed from a polymer selected from the group consisting of nylon, polyester, and polypropylene.

5. The cleaning structure as recited in claim 4, wherein said at least one adjustable length cable is a monofilament.

6. The cleaning structure as recited in claim 1 wherein said polymer ribbons are formed from a polymer selected from the group consisting of nylon, polyester, and polypropylene.

7. An adjustable curvature cleaning structure adapted to clean both flat and curved surfaces, the cleaning structure comprising:

a frame comprising a base operatively engaging an elongated handle structure and at least one arm projecting away from the base, said at least one arm comprising a plurality of link elements of polymer or metal with hinges disposed between said link elements such that said at least one arm is bendable upwardly and downwardly in curved relation relative to said base;

at least one adjustable length cable extending along said at least one arm and further comprising a length adjustment mechanism, wherein the length adjustment mechanism comprises a worm gear operatively connected to a rotatably adjustable spool adapted to take up and release portions of said at least one adjustable length cable in response to adjustment of said worm gear.

8. The cleaning structure as recited in claim 7, wherein said worm gear and spool are each formed from a polymer selected from the group consisting of nylon, polyester, and polypropylene.

9. An adjustable curvature cleaning structure adapted to clean both flat and curved surfaces, the cleaning structure comprising:

a frame comprising a base operatively engaging an elongated handle structure and a pair of arms projecting laterally away from opposing sides of the base, the arms comprising a plurality of link elements of polymer or metal with living hinges disposed between said link elements such that said arms are bendable upwardly and downwardly in curved relation relative to said base;

adjustable length cables extending along said arms, wherein proximal ends of said cables are operatively connected to a length adjustment mechanism disposed at said base, wherein the length adjustment mechanism comprises a worm gear operatively connected to a ring gear surrounding a rotatably adjustable spool engaging said cables and adapted to take up and release portions of said adjustable length cables in response to adjustment of said worm gear.

* * * * *